US012529199B2

(12) United States Patent
Lee

(10) Patent No.: US 12,529,199 B2
(45) Date of Patent: Jan. 20, 2026

(54) EXCAVATOR BUCKET

(71) Applicant: Kang Jun Lee, Seosan-si (KR)

(72) Inventor: Kang Jun Lee, Seosan-si (KR)

( * ) Notice: Subject to any disclaimer, the term of this patent is extended or adjusted under 35 U.S.C. 154(b) by 421 days.

(21) Appl. No.: 18/027,837

(22) PCT Filed: Jul. 19, 2022

(86) PCT No.: PCT/KR2022/010510
§ 371 (c)(1),
(2) Date: Mar. 22, 2023

(87) PCT Pub. No.: WO2023/013925
PCT Pub. Date: Feb. 9, 2023

(65) Prior Publication Data

US 2023/0332373 A1 Oct. 19, 2023

(30) Foreign Application Priority Data

Aug. 5, 2021 (KR) ..... 10-2021-0103171

(51) Int. Cl.
*E02F 3/40* (2006.01)

(52) U.S. Cl.
CPC ..... *E02F 3/40* (2013.01)

(58) Field of Classification Search
CPC ..... E02F 3/40
See application file for complete search history.

(56) References Cited

U.S. PATENT DOCUMENTS

2009/0183398 A1 7/2009 McClallen et al.
2016/0273185 A1* 9/2016 Chabura ..... E02F 3/40

FOREIGN PATENT DOCUMENTS

KR 10-1366614 B1 2/2014
KR 10-2078029 B1 2/2020
KR 10-2080913 B1 2/2020
KR 10-2360921 B1 2/2022
WO WO-2021045951 A1 * 3/2021 ..... E02F 3/3609

* cited by examiner

*Primary Examiner* — Matthew R Buck
(74) *Attorney, Agent, or Firm* — Bridgeway IP Law Group, PLLC; Sang Ho Lee; Hyun Woo Shin

(57) ABSTRACT

Provided is an excavator bucket including a bottom part forming bottom thereof, bent upward, and extending in a rear direction thereof, first and second side parts coupled to both sides of the bottom part, a cover part forming top thereof, a support part coupled to at least a portion of the cover part and at least a portion of the bottom part and forming the inner surface thereof, a first coupling bracket coupled to the cover part, the support part, and the bottom part and protruding upward and outward therefrom, and a second coupling bracket located on a position symmetrical to the first coupling bracket, wherein the cover part comprises a first cover part located between the first coupling bracket and the first side part and a second cover part located between the first coupling bracket and the second coupling bracket, and when viewed on the side of the excavator bucket, a height of the first cover part traversing the first coupling bracket is higher than a height of the second cover part traversing the first coupling bracket.

10 Claims, 9 Drawing Sheets

EXCAVATOR BUCKET

TECHNICAL FIELD

The present invention relates to an excavator bucket, and more specifically, to an excavator bucket that is capable of allowing both of a general coupler and a tilt coupler for an excavator to be applied thereto.

BACKGROUND ART

Excavators are heavy construction equipment that is widely used for excavation, loading, and the like. The excavator is movable using power and thus operates in a state of coupling various types of buckets to an arm. Excavator couplers for connecting an excavator bucket to the excavator are classified into general couplers for rotating the bucket in forward and backward directions and tilt couplers for rotating the bucket in left and right directions as well as in forward and backward directions. Accordingly, a general bucket and a tilt bucket have to be coupled alternately to the bucket coupler according to types of work as required, which causes many inconveniences.

If the excavator bucket is used for long hours after coupled to the coupler or a large weight or force is applied to the excavator bucket, further, a coupled portion of the excavator bucket to the coupler may be cracked. Accordingly, studies of structures capable of preventing the occurrence of cracks on the coupled portion of the excavator bucket have been made.

DISCLOSURE OF THE INVENTION

Technical Problem

Accordingly, it is an object of the present invention to provide an excavator bucket that is capable of allowing both of a general coupler and a tilt coupler for an excavator to be applied thereto and improving a coupling structure among a cover part having a bent portion, a support part, and coupling brackets to thus ensure high strength and rigidity.

The technical problems to be achieved through the present invention are not limited as mentioned above, and other technical problems not mentioned herein will be obviously understood by one of ordinary skill in the art through the following description.

Technical Solution

An excavator bucket according to an embodiment of the present invention may include a bottom part forming bottom thereof, bent upward, and extending in a rear direction thereof, first and second side parts coupled to both sides of the bottom part, a cover part forming top thereof, a support part coupled to at least a portion of the cover part and at least a portion of the bottom part and forming the inner surface thereof, a first coupling bracket coupled to the cover part, the support part, and the bottom part and protruding upward and outward therefrom, and a second coupling bracket located on a position symmetrical to the first coupling bracket, wherein the cover part comprises a first cover part located between the first coupling bracket and the first side part and a second cover part located between the first coupling bracket and the second coupling bracket, and when viewed on the side of the excavator bucket, a height of the first cover part traversing the first coupling bracket is higher than a height of the second cover part traversing the first coupling bracket.

The first cover part may traverse a height higher than or equal to ½ of the height of the first coupling bracket, and the second cover part may traverse a height lower than or equal to ⅓ of the height of the first coupling bracket.

The first coupling bracket may include a first rod insertion portion having a rod hole into which a first coupling rod is inserted, a second rod insertion portion having a rod hole into which a second coupling rod is inserted, and a central extension portion located between the first rod insertion portion and the second rod insertion portion, and the first cover part may include an upper extension portion coupled to one side surface of the central extension portion, a bent portion bentedly extending from one end of the upper extension portion and coupled to one side surface of the first rod insertion portion, and a first rear portion bent from the other end of the upper extension portion, extending in the rear direction, and coupled to one side surface of the second rod insertion portion.

An angle between the upper extension portion and the bent portion is an obtuse angle larger than 90°, and an angle between the upper extension portion and the first rear portion is an obtuse angle larger than the angle between the upper extension portion and the bent portion.

The support part may include a coupling portion coupled to the bent portion, a lower extension portion extending from the coupling portion in the rear direction, spaced apart from the upper extension portion, and having at least a portion coupled to the first rear portion, and a second rear portion bentedly extending from the lower extension portion and coupled to the first coupling bracket and the bottom part.

The coupling portion may include first to fourth sub coupling portions, the third sub coupling portion being coupled to the bent portion, the second sub coupling portion bentedly extending from the third sub coupling portion to an obtuse angle larger than 90° and coupled to the first coupling bracket, the first sub coupling portion bentedly extending from the second sub coupling portion to an obtuse angle larger than 90° in the rear direction and coupled to the lower extension portion, and one end of the fourth sub coupling portion being coupled to the first sub coupling portion close to the second sub coupling portion and the other end thereof being coupled to the upper extension portion close to the bent portion.

When viewed on the front side of the excavator bucket, the width of the fourth sub coupling portion may be smaller than the width between the first side part and the first coupling bracket, and the fourth sub coupling portion may be coupled to the first coupling bracket.

The separation distance between the upper extension portion and the lower extension portion may become small in the rear direction of the excavator bucket.

The bottom part may include a first bottom part located on the front side thereof and having a flat shape, a second bottom part extending from the first bottom part in the rear direction thereof and having a flat shape, and a third bottom part being bent upward from the second bottom part to a given curvature and thus coupled to the support part, the given curvature being in the range of 70 to 80°.

The excavator bucket may further include a plurality of tooth parts having respective adaptors, the plurality of tooth parts being coupled spaced apart from one another on the first bottom part, and at least two tooth parts of the plurality of tooth parts being coupled to the first side part and the second side part.

The bottom part may include a first bottom part located on the front side thereof and having a flat shape, a plurality of horizontal bars, and a plurality of vertical plates, and the first side part and the second side part comprise a plurality of holes having a plurality of first holes penetratedly formed on the excavator bucket and a plurality of second holes to which the plurality of horizontal bars are coupled, the plurality of vertical plates extending from the first bottom part, bent upward along the outer shape of the first side part, and coupled to the support part, and the plurality of horizontal bars and the plurality of vertical plates crossing perpendicularly.

Details of the embodiments of the present invention will be explained in the description and drawings.

Advantageous Effects

According to the present invention, the excavator bucket can improve the strength and rigidity thereof and in advance prevent the occurrence of cracks on the coupling brackets and/or coupling rods.

In addition, it is advantageous in decreasing the weight of the excavator bucket and in loading a large number of objects therein.

The effectiveness of the invention is not limited as mentioned above, and other types of effectiveness may be included in the detailed description of the present invention.

MODE FOR INVENTION

Figure 1:
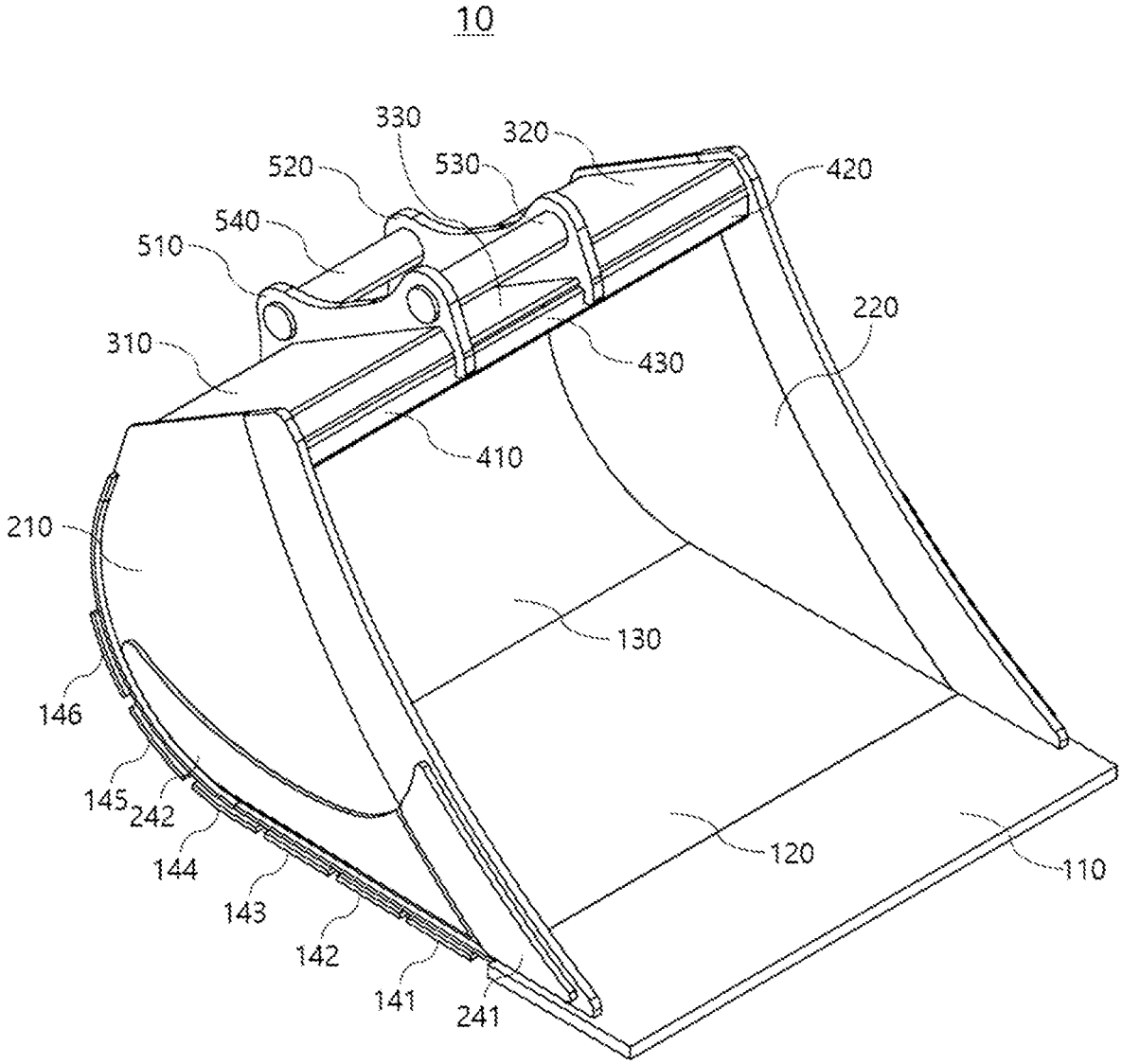
FIG. 1 is a front perspective view showing an excavator bucket according to an embodiment of the present invention.

Objects, characteristics and advantages of the present invention will be more clearly understood from the detailed description as will be described below and the attached drawings. Before the present invention is disclosed and described, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure.

It will be understood that when an element or layer is referred to as being "on" another element or layer, it can be the element or layer just on another element or layer, or another intervening element or layer may also be present. The corresponding parts in the embodiments of the present invention are indicated by corresponding reference numerals. The shapes, sizes, percentages, angles, and numbers of parts shown in the attached drawings are just exemplary, and therefore, the present invention may not be limited thereto.

Terms, such as the first, the second, and the like may be used to describe various elements, but the elements should not be restricted by the terms. The terms are used to only distinguish one element from the other element. For example, a first element may be named a second element without departing from the scope of the present invention.

Figure 2:
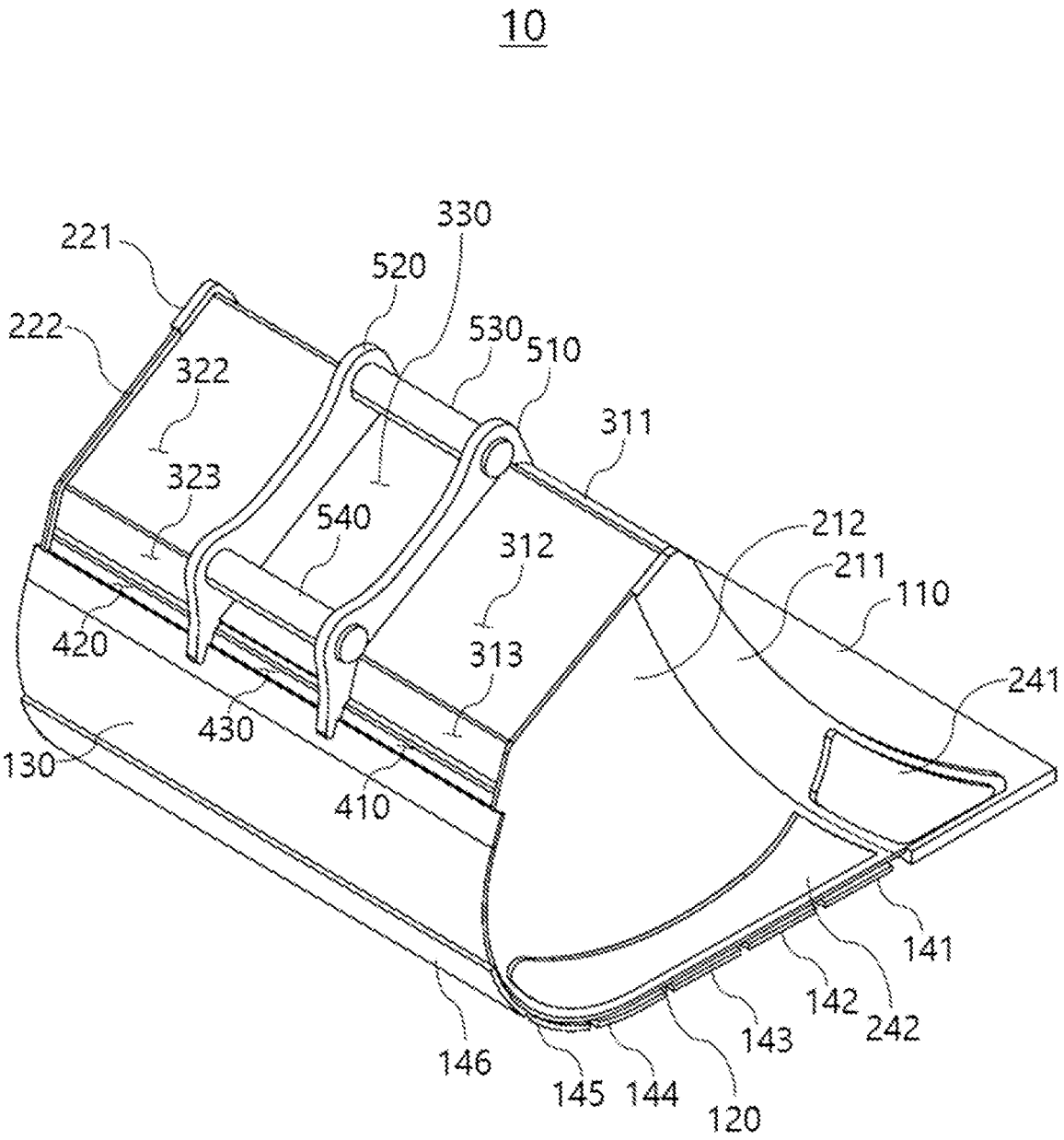
FIG. 2 is a rear perspective view showing the excavator bucket according to the embodiment of the present invention.

FIG. 1 is a front perspective view showing an excavator bucket according to an embodiment of the present invention. FIG. 2 is a rear perspective view showing the excavator bucket according to the embodiment of the present invention.

Referring to FIGS. 1 and 2, an excavator bucket 10 according to an embodiment of the present invention includes a bottom part 100, a side part 200, a cover part 300, a support part 400, and a coupling part 500.

The bottom part 100 forms a bottom of the excavator bucket 10. The bottom part 100 includes a first bottom part 110, a second bottom part 120, and a third bottom part 130. The first bottom part 110 is located on the front side of the excavator bucket 10 and has at least a portion protruding more forwardly when compared with the side part 200. Accordingly, it is advantageous in loading objects into the excavator bucket 10 or digging the soil using the excavator bucket 10.

The second bottom part 120 extends from the first bottom part 110. The first bottom part 110 and the second bottom part 120 have flat shapes. However, the second bottom part 120 may be bent upward, without being limited thereto.

The third bottom part 130 extends from the second bottom part 120 and is bent upward and thus coupled to the support part 400. The third bottom part 130 has a curvature of about 70 to 80° so that it is structurally rigid and advantageous in supporting a force applied thereto. Further, the third bottom part 130 makes the volume in the internal space of the excavator bucket 10 relatively large so that it is advantageous in loading a large number of objects in the excavator bucket 10.

The first bottom part 110, the second bottom part 120, and the third bottom part 130 are formed integrally with one another. However, at least one of the first to third bottom parts 110, 120, and 130 may be coupledly separated therefrom, without being limited thereto. For example, the second and third bottom parts 120 and 130 are formed integrally with each other, and the first bottom part 110 is coupledly separated from the second bottom part 120. In this case, the first bottom part 110 has a higher thickness than the second and third bottom parts 120 and 130, thereby being advantageous in digging the soil or performing demolition work.

According to the embodiment of the present invention, the bottom part 100 further includes a bottom reinforcing part 140 so as to enhance the strength of the excavator bucket 10. The bottom reinforcing part 140 is located on the outer surfaces of the second bottom part 120 and the third bottom part 130 and thus coupled to at least any one of the second bottom part 120 and the third bottom part 130.

For example, the bottom reinforcing part 140 includes first to sixth bottom reinforcing parts 141, 142, 143, 144, 145, and 146. The first to third bottom reinforcing parts 141, 142, and 143 are located spaced apart from the outer surface of the second bottom part 120, the fifth and sixth bottom reinforcing parts 145 and 146 are located spaced apart from the outer surface of the third bottom part 130, and the fourth bottom reinforcing part 144 is laid on the boundary between the second bottom part 120 and the third bottom part 130 on the outer surfaces thereof. If the second bottom part 120 and the third bottom part 130 are formed independently of each other and then coupled to each other, the fourth bottom reinforcing part 144 is provided to allow the second bottom part 120 and the third bottom part 130 to be rigidly coupled to each other.

The first to third bottom reinforcing parts 141, 142, and 143 have flat shapes, the fifth and sixth bottom reinforcing parts 145 and 146 have the shapes with substantially the same curvature as the third bottom part 130, and an area of the fourth bottom reinforcing part 144, which is coupled to the second bottom part 120, has a flat shape, while an area coupled to the third bottom part 130 has the shape with substantially the same curvature as the third bottom part 130.

According to the embodiment of the present invention, it is illustrated that the excavator bucket 10 includes the six bottom reinforcing parts 141, 142, 143, 144, 145, and 146, but without being limited thereto, the excavator bucket 10 may have bottom reinforcing parts with various numbers or a single bottom reinforcing part laid on the boundary between the second bottom part 120 and the third bottom part 130 on their outer surfaces.

The side part 200 includes a first side part 210 and a second side part 220. The first side part 210 and the second side part 220 are coupled to both sides of the bottom part 100. The first side part 210 includes a first sub side part 211 and a second sub side part 212, and the second side part 220 includes a third sub side part 221 and a fourth sub side part 222.

The first sub side part 211 and the third sub side part 221 are coupled to the first bottom part 110 and the second bottom part 120, and the second sub side part 212 and the fourth sub side part 222 are coupled to the second bottom part 120 and the third bottom part 130.

The first sub side part 211 and the third sub side part 221 have higher thicknesses than the second sub side part 212 and the fourth sub side part 222. As the strength of the excavator bucket 10 is improved, accordingly, it is advantageous in digging the soil. However, the first sub side part 211 and the third sub side part 221 may have the same thicknesses as the second sub side part 212 and the fourth sub side part 222, without being limited thereto. In this case, the first side part 210 and the second side part 220 may be formed integrally with each other.

The first side part 210 further includes a first side reinforcing part 241 and a second side reinforcing part 242, and the second side part 220 further includes a third side reinforcing part 251 and a fourth side reinforcing part 252. It is accordingly advantageous in improving the strength of the excavator bucket 10.

The first side reinforcing part 241 is coupled to the outer surface of the first sub side part 211, and the second side reinforcing part 242 to the outer surface of the second sub side part 211. Only the first side reinforcing part 241 and the second side reinforcing part 242 are shown in FIGS. 1 and 2, but in the same manner as above, the third side reinforcing part 251 and the fourth side reinforcing part 252 are coupled to the outer surface of the second side part 220. That is, the third side reinforcing part 251 is coupled to the outer surface of the third sub side part 221, and the fourth side reinforcing part 252 to the outer surface of the fourth sub side part 222. As a result, it is advantageous in enhancing the strength and rigidity of the excavator bucket 10.

The cover part 300 forms top of the excavator bucket 10. The cover part 300 includes a first cover part 310, a second cover part 320, and a third cover part 330. The first cover part 310 is located between the first side part 210 and a first coupling bracket 510, the second cover part 320 between the second side part 220 and a second coupling bracket 520, and the third cover part 330 between the first coupling bracket 510 and the second coupling bracket 520.

The support part 400 forms the inner surface of the excavator bucket 10, together with the second bottom part 120 and the third bottom part 130. The support part 400 includes a first support part 410, a second support part 420, and a third support part 430. The first support part 410 is located between the first side part 210 and the first coupling bracket 510, the second support part 420 between the second side part 220 and the second coupling bracket 520, and the third support part 430 between the first coupling bracket 510 and the second coupling bracket 520.

An explanation of the cover part 300 and the support part 400 will be given in detail later with reference to FIGS. 3 to 5.

The first coupling bracket 510 and the second coupling bracket 520 are coupled to the support part 400, the cover part 300, and the third bottom part 130. The first coupling bracket 510 and the second coupling bracket 520 protrude upward and outward from the excavator bucket 10. The first coupling bracket 510 and the second coupling bracket 520 have rod holes penetratedly formed therein in lateral directions thereof. For example, the first coupling bracket 510 and the second coupling bracket 520 each have two rod holes, and a first coupling rod 530 and a second coupling rod 540 are insertedly coupled to the two rod holes.

The first coupling rod 530 and the second coupling rod 540 are coupled to the first coupling bracket 510 and the second coupling bracket 520 by means of hole filling welding, thereby enhancing rigidity in coupling to advantageously improve the strength of the excavator bucket 10. However, the coupling method between the coupling rods 530 and 540 and the coupling brackets 510 and 520 may not be limited thereto. That is, the first coupling rod 530 and the second coupling rod 540 may be coupled to a bucket coupler of an excavator. Accordingly, an excavator boom is coupled to the excavator bucket.

Figure 3:
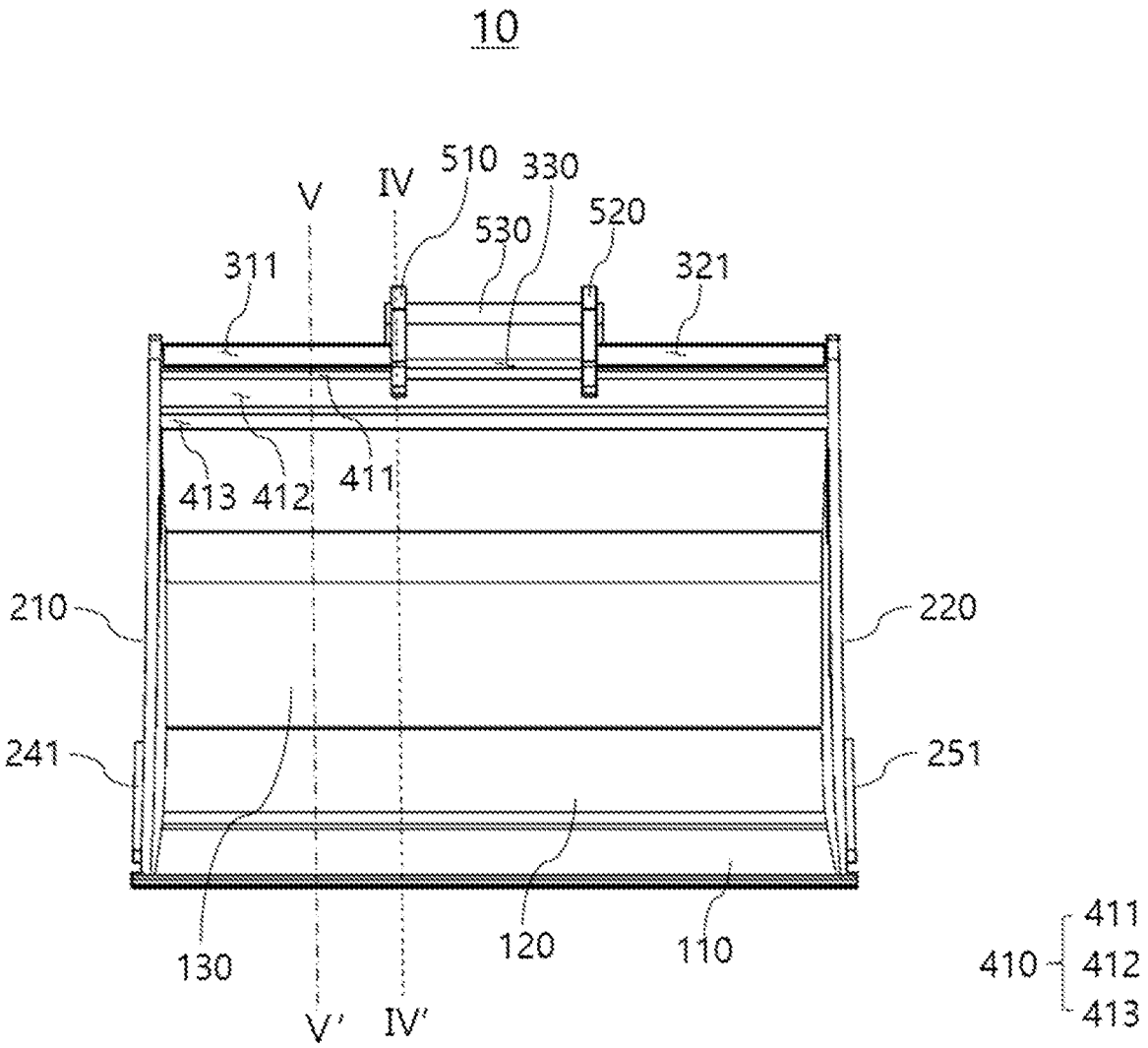
FIG. 3 is a front view showing the excavator bucket according to the embodiment of the present invention.

FIG. 3 is a front view showing the excavator bucket 10 according to the embodiment of the present invention. FIG. 4 is a sectional view showing the excavator bucket 10 cut along the line IV-IV' of FIG. 3.

Figure 4:
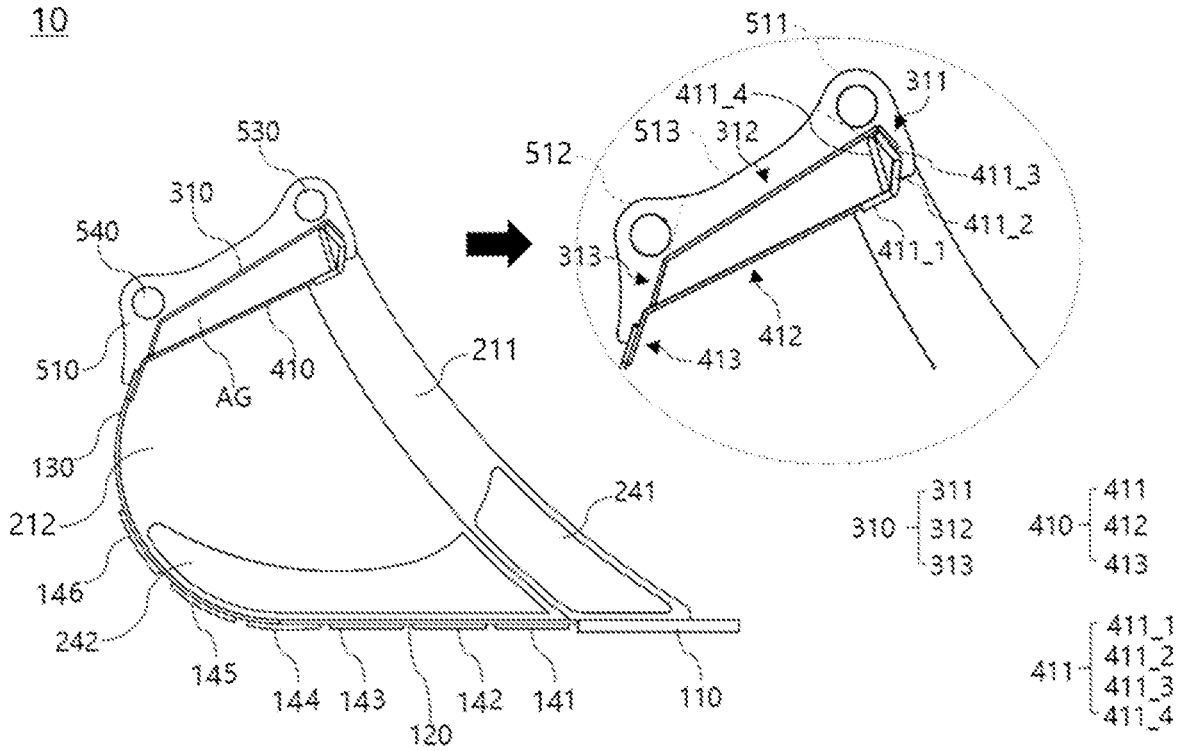
FIG. 4 is a sectional view showing the excavator bucket cut along the line IV-IV' of FIG. 3.

Referring to FIGS. 3 and 4, the first cover part 310 includes a bent portion 311, an upper extension portion 312, and a first rear portion 313. Hereinafter, the first cover part 310 located between the first coupling bracket 510 and the first side part 210 will be chiefly explained, but the second cover part 320 located between the second coupling bracket 520 and the second side part 220 may also have substantially the same structure (or symmetrical structure) as the first cover part 310. Further, the third cover part 330 located between the first coupling bracket 510 and the second coupling bracket 520 will be explained later with reference to FIG. 5.

One side of the first cover part 310 is coupled to the first coupling bracket 510, and the other side thereof to the first side part 210. Further, the bent portion 311 and the first rear portion 313 are coupled to the support part 400.

The bent portion 311 has one surface located toward a diagonal direction with respect to the front surface of the excavator bucket 10 and the other surface located toward a diagonal direction with respect to the rear surface of the excavator bucket 10. According to the embodiment of the present invention, the bent portion 311 of the first cover part 310 is coupled to the support part 400 on the rear surface thereof, and if an external force is applied to the first coupling bracket 510, accordingly, the bent portion 311 distributes the external force to in advance prevent the occurrence of cracks on the first coupling bracket 510 and the coupling rods 530 and 540.

The upper extension portion 312 bentedly extends to a given angle from the bent portion 311 in a rear direction of the excavator bucket 10. In this case, the given angle is an obtuse angle larger than 90°, but it may not be limited thereto. The upper extension portion 312 is flat, without protruding upward or downward.

When viewed on the side of the excavator bucket 10, the upper extension portion 312 has the shape of traversing about half of the height of the first coupling bracket 510. Such a structure has higher strength and rigidity than a structure wherein the upper extension portion 312 has the shape of traversing a given height lower than about half of the height of the first coupling bracket 510 and is more advantageous in distributing an external force than the structure if the external force is applied to the first coupling bracket 510. Accordingly, it is advantageous in preventing the occurrence of cracks on the first coupling bracket 510 and the coupling rods 530 and 540 in advance.

The first rear portion 313 bentedly extends to an obtuse angle larger than 90° from the upper extension portion 312. The first rear portion 313 is coupled to the support part 400. An angle between the first rear portion 313 and the upper extension portion 312 is larger than the angle between the bent portion 311 and the upper extension portion 312, but it may not be limited thereto.

The bent portion 311, the upper extension portion 312, and the first rear portion 313 are formed integrally with one another, but they may not be limited thereto. For example, at least one of the bent portion 311, the upper extension portion 312, and the first rear portion 313 may be separated and thus coupled thereto. In the case where the bent portion 311, the upper extension portion 312, and the first rear portion 313 are formed integrally with one another, however, it is more advantageous in enhancing the strength and rigidity of the excavator bucket 10.

The first support part 410 includes a coupling portion 411, a lower extension portion 412, and a second rear portion 413. Hereinafter, the first support part 410 located between the first coupling bracket 510 and the first side part 210 will be chiefly explained, but the second support part 420 located between the second coupling bracket 520 and the second side part 220 may also have substantially the same structure as the first support part 410. Further, the third support part 430 located between the first coupling bracket 510 and the second coupling bracket 520 will be explained later with reference to FIG. 5.

One side of the first support part 410 is coupled to the first coupling bracket 510, and the other side thereof to one side of the third support part 430. Further, the coupling portion 411 is coupled to the bent portion 311 of the first cover part 310, the lower extension portion 412 to the first rear portion 313 of the first cover part 310, and the second rear portion 413 to the third bottom part 130. Furthermore, one surface of the support part 400, which is located on the boundary between the first support part 410 and the third support part 430, is coupled to the first coupling bracket 510.

The coupling portion 411 includes a first sub coupling portion 411-1, a second sub coupling portion 411-2, a third sub coupling portion 411-3, and a fourth sub coupling portion 411-4.

One surface of the third sub coupling portion 411-3 is coupled to the other surface of the bent portion 311 of the first cover part 310. The second sub coupling portion 411-2 bentedly extends to an obtuse angle larger than 90° from the third sub coupling portion 411-3, and the first sub coupling portion 411-1 bentedly extends to an obtuse angle larger than 90° from the second sub coupling portion 411-2. One end of the fourth sub coupling portion 411-4 is coupled to the first sub coupling portion 411-1 close to the second sub coupling portion 411-2, and the other end thereof to the upper extension portion 312 and the third sub coupling portion 411-3 close to the bent portion 311. Accordingly, the second to fourth sub coupling portions 411-2, 411-3, and 411-4 have the shape having a triangular section with an obtuse angle larger than 90° between the second sub coupling portion 411-2 and the third sub coupling portion 411-3.

Under such a structure, it is advantageous in distributing an external force if the external force is applied to the first coupling bracket 510, and accordingly, it is advantageous even in enhancing the strength and rigidity of the excavator bucket 10. Further, there is no need for any structure located between the first coupling bracket 510 and the first side part 210 to perform additional reinforcing functions, and accordingly, it is advantageous in decreasing the weight of the excavator bucket 10.

According to some embodiments of the present invention, the fourth sub coupling portion 411-4 may be spaced apart from the first side part 210, while being coupled to one side surface of the first coupling bracket 510. In specific, when viewed on the front side of the excavator bucket 10, the width of the fourth sub coupling portion 411-4 is smaller than the widths of the first to third sub coupling portions 411-1, 411-2, and 411-3. As a result, it is advantageous in enhancing the strength and rigidity of the excavator bucket 10 and decreasing the weight of the excavator bucket 10.

The first to fourth sub coupling portions 411-1, 411-2, 411-3, and 411-4 are formed integrally with one another. However, for example, the first to third sub coupling portions 411-1, 411-2, and 411-3 may be formed integrally with one another, while the fourth sub coupling portion 411-4 is coupledly separated therefrom, without being limited thereto.

The lower extension portion 412 extends from the first sub coupling portion 411-1 in the rear direction of the excavator bucket 10. One end of the lower extension portion 412 is coupled to the first sub coupling portion 411-1, and the other end thereof to the first rear portion 313. The lower extension portion 412 is flat, without protruding upward or downward. The lower extension portion 412 is located spaced apart from the upper extension portion 312.

The first cover part 310, the first to third sub coupling portions 411-1, 411-2, and 411-3, and the lower extension portion 412 have the shape with a pentagonal section, while a separation distance between the lower extension portion 412 and the upper extension portion 312 is close to each other toward the rear direction of the excavator bucket 10. That is, the height of an internal cavity AG formed between the cover part 300 and the support part 400 becomes lower as it goes toward the rear direction of the excavator bucket 10. Further, the fourth sub coupling portion 411-4 is coupled to the upper extension portion 312 and the first sub coupling portion 411-1. Under such a structure, it is advantageous in enhancing the strength and rigidity of the excavator bucket 10 and decreasing the weight of the excavator bucket 10.

The second rear portion 413 bentedly extends to an obtuse angle larger than 90° from the lower extension portion 412. The second rear portion 413 is coupled to the third bottom part 130 and the first coupling bracket 510. One surface of the second rear portion 413 forms a portion of the inner surface of the excavator bucket 10, and at least a portion of the other surface thereof is coupled to the third bottom part 130. Like this, the second rear portion 413 is bent to the obtuse angle larger than 90° from the lower extension portion 412 and thus coupled to the third bottom part 130, so that the internal volume of the excavator bucket 10 relatively increases.

The coupling portion 411, the lower extension portion 412, and the second rear portion 413 are formed integrally with one another, but they may not be limited thereto. For example, the lower extension portion 412 and the second rear portion 413 are formed integrally with each other, and the coupling portion 411 is separated therefrom and thus coupled to one end of the lower extension portion 412. In this case, the thickness of the coupling portion 411 is higher than thicknesses of the lower extension portion 412 and the second rear portion 413. As a result, it is advantageous in enhancing the strength and rigidity of the excavator bucket 10.

The first coupling bracket 510 includes a first rod insertion portion 511 into which the first coupling rod 530 is inserted, a second rod insertion portion 512 into which the second coupling rod 540 is inserted, and a central extension portion 513 located between the first rod insertion portion 511 and the second rod insertion portion 512. Hereinafter, the first coupling bracket 510 will be chiefly explained, but the second coupling bracket 520 may also have substantially the same structure as the first coupling bracket 510.

The first rod insertion portion 511 is coupled to the first cover part 310 and the first support part 410, the second rod insertion portion 513 to the first cover part 310, the first support part 410, and the third bottom part 130, and the central extension portion 513 to the first cover part 310.

When viewed on the front side of the excavator bucket 10, in specific, one side surface of the first rod insertion portion 511 is coupled to the upper extension portion 312, the bent portion 311, and the third sub coupling portion 411-3, and at least a portion of the lower portion of the first rod insertion portion 511 to at least a portion of the second sub coupling portion 411-2. For example, at least a portion of the lower surface of the first rod insertion portion 511 is coupledly fitted to the second sub coupling portion 411-2.

Further, one side surface of the second rod insertion portion 512 is coupled to the first rear portion 313, and the lower surface of the second rod insertion portion 512 to at least a portion of the second rear portion 413 and at least a portion of the third bottom part 130. One side surface of the central extension portion 513 is coupled to the upper extension portion 312. Like this, the lower surface of the second rod insertion portion 512 is located even on the rear surface of the excavator bucket 10, so that it is advantageous in enhancing the strength and rigidity of the excavator bucket 10.

A coupling relation of the second coupling bracket 520 to the second cover part 320 and the second support part 420 is the same (or symmetrical) as the coupling relation of the first coupling bracket 510 to the first cover part 310 and the first support part 410, and accordingly, an explanation of the coupling relation for the second coupling bracket 520 will be avoided.

Figure 5:
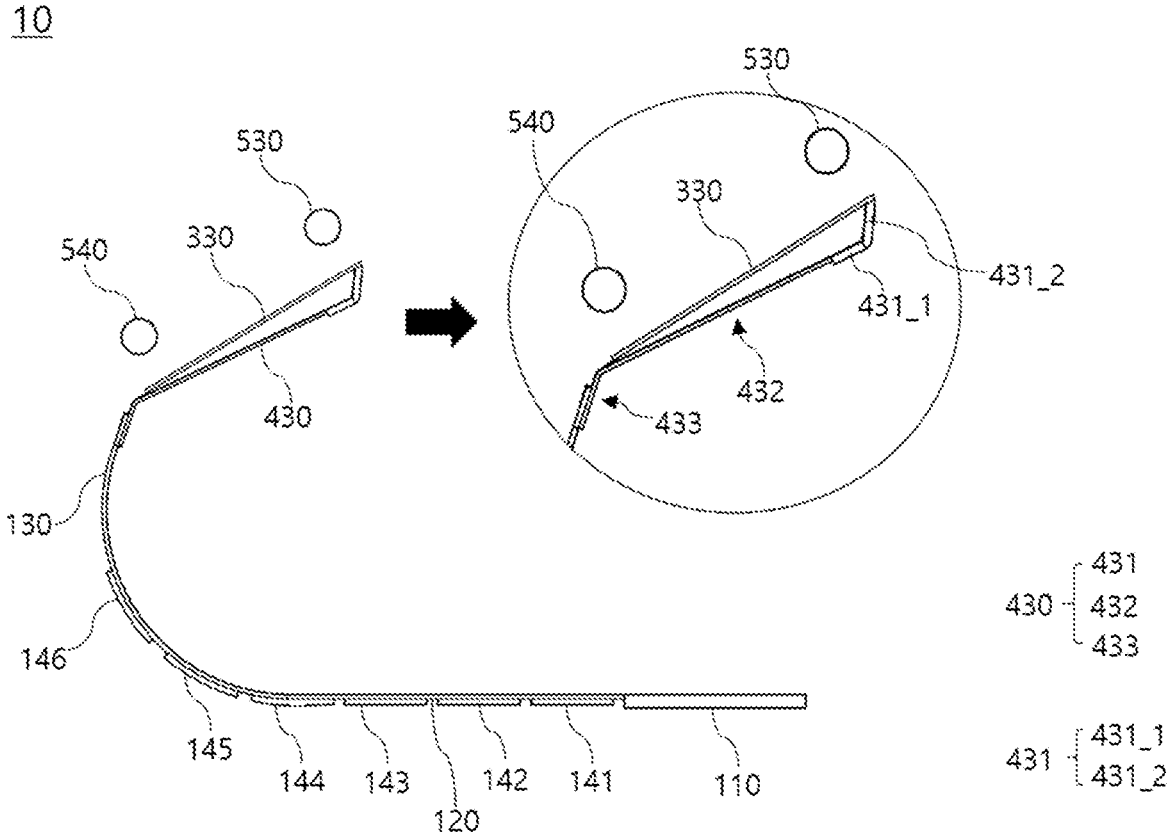
FIG. 5 is a sectional view showing the excavator bucket cut along the line V-V' of FIG. 3.

FIG. 5 is a sectional view showing the excavator bucket 10 cut along the line V-V' of FIG. 3.

Referring to FIGS. 3 to 5, when viewed on the front side of the excavator bucket 10, one side of the third cover part 330 is coupled to the other side of the second coupling bracket 520, and the other side thereof to one side of the first coupling bracket 510. Further, the third cover part 330 is coupled to the third support part 430.

For example, as shown in FIG. 5, the third cover part 330 is flat, without protruding upward or downward, and one end and the other end of the third cover part 330 are coupled to the third support part 430.

When viewed on the side of the excavator bucket 10, the third cover part 330 has the shape of traversing about ⅓ of the heights of the first coupling bracket 510 and the second coupling bracket 520. As a result, it is easy to couple the bucket coupler of the excavator to the coupling rods 530 and 540. Under such a structure, further, it is easy to deliver a plurality of excavator buckets 10.

One side of the third support part 430 is coupled to the other side of the first support part 410, and the other side thereof to one side of the second support part 420.

The third support part 430 includes a coupling portion 431, a lower extension portion 432, and a second rear portion 433. The coupling portion 431 includes a first sub coupling portion 431-1 and a second sub coupling portion 431-2. The first sub coupling portion 431-1 and the second sub coupling portion 431-2 of the third support part 430 have substantially the same shape as the first sub coupling portion 411-1 and the second sub coupling portion 411-2 of the first support part 410.

The lower extension portion 432 and the second rear portion 433 of the third support part 430 have substantially the same shape as the lower extension portion 412 and the second rear portion 413 of the first support part 410. The second sub coupling portion 431-2 and the lower extension portion 432 are coupled to the third cover part 330.

The first to third support parts 410, 420, and 430 are formed integrally with one another. That is, the support part 400 is a unitary body, and the first to third support parts 410, 420, and 430 are the areas divided by the coupling brackets 510 and 520. Further, as mentioned above, the lower extension portions 412, 422, and 432 and the second rear portions 413, 423, and 433 of the first to third support parts 410, 420, and 430 are formed integrally with one another, the coupling portions 411, 421, and 431 of the first to third support parts 410, 420, and 430 are formed integrally with one another, and the lower extension portions 412, 422, and 432 of the first to third support parts 410, 420, and 430 are coupled to the coupling portions 411, 421, and 431 thereof. In this case, the coupling portions 411, 421, and 431 have higher thicknesses than the lower extension portions 412, 422, and 432 and the second rear portions 413, 423, and 433, thereby enhancing the strength and rigidity of the excavator bucket 10.

Like this, the excavator bucket 10 according to the embodiment of the present invention is configured to allow the third cover part 330 having a relatively lower height than the first and second cover parts 310 and 320 to be located between the first coupling bracket 510 and the second coupling bracket 520 and to allow the first cover part 310 and the second cover part 320 having relatively higher heights than the third cover part 330 to be located between the coupling brackets 510 and 520 and the side parts 210 and 220, so that if an external force is applied to the excavator bucket 10, it is easy to distribute the external force to thus prevent the occurrence of cracks on the coupling brackets 510 and 520 or the coupling rods 530 and 540 in advance, and further, it is advantageous in decreasing the weight of the excavator bucket 10 and coupling the bucket coupler of the excavator to the coupling rods 530 and 540.

Figure 6:
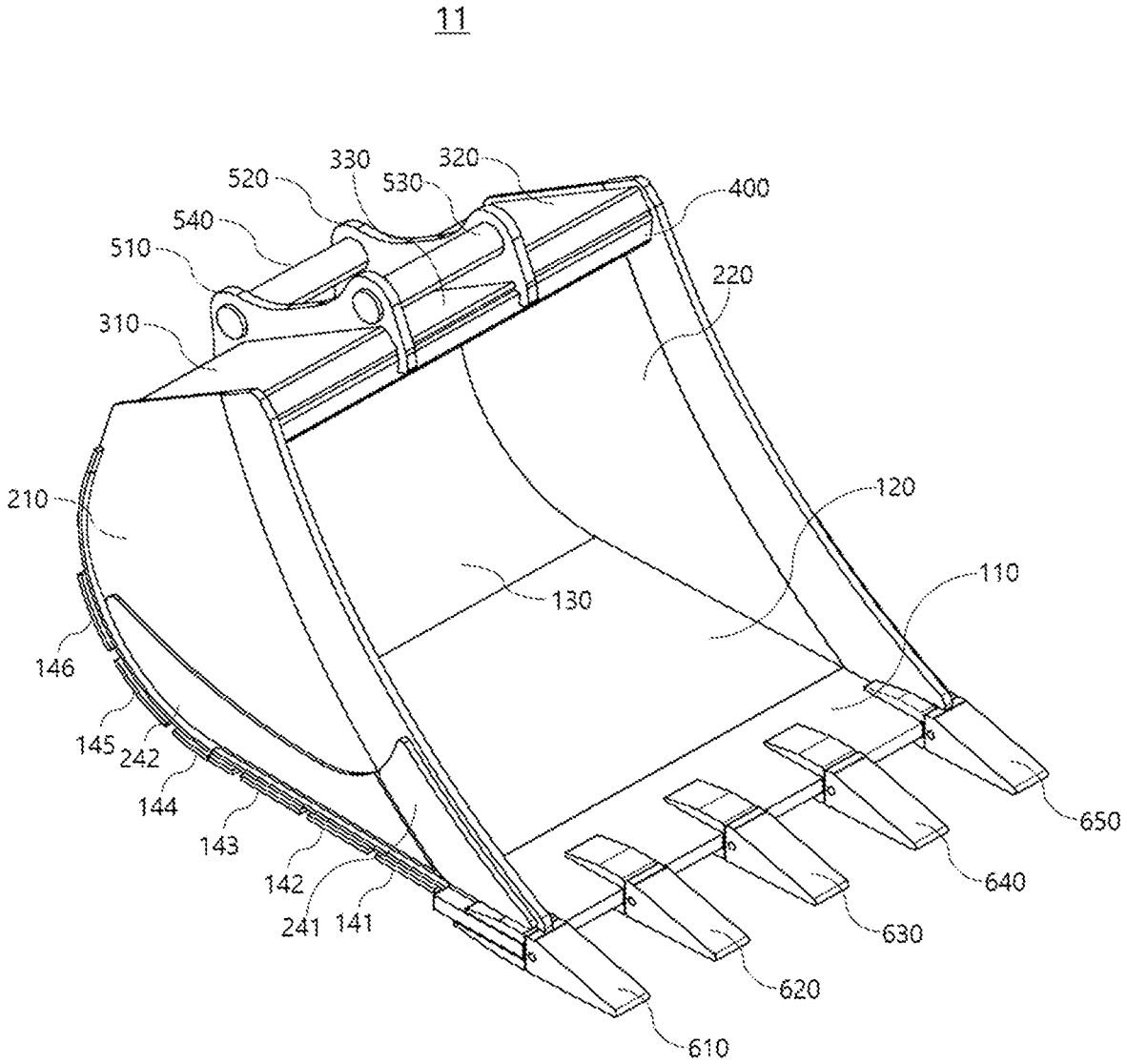
FIG. 6 is a front perspective view showing an excavator bucket according to another embodiment of the present invention.
Figure 7:
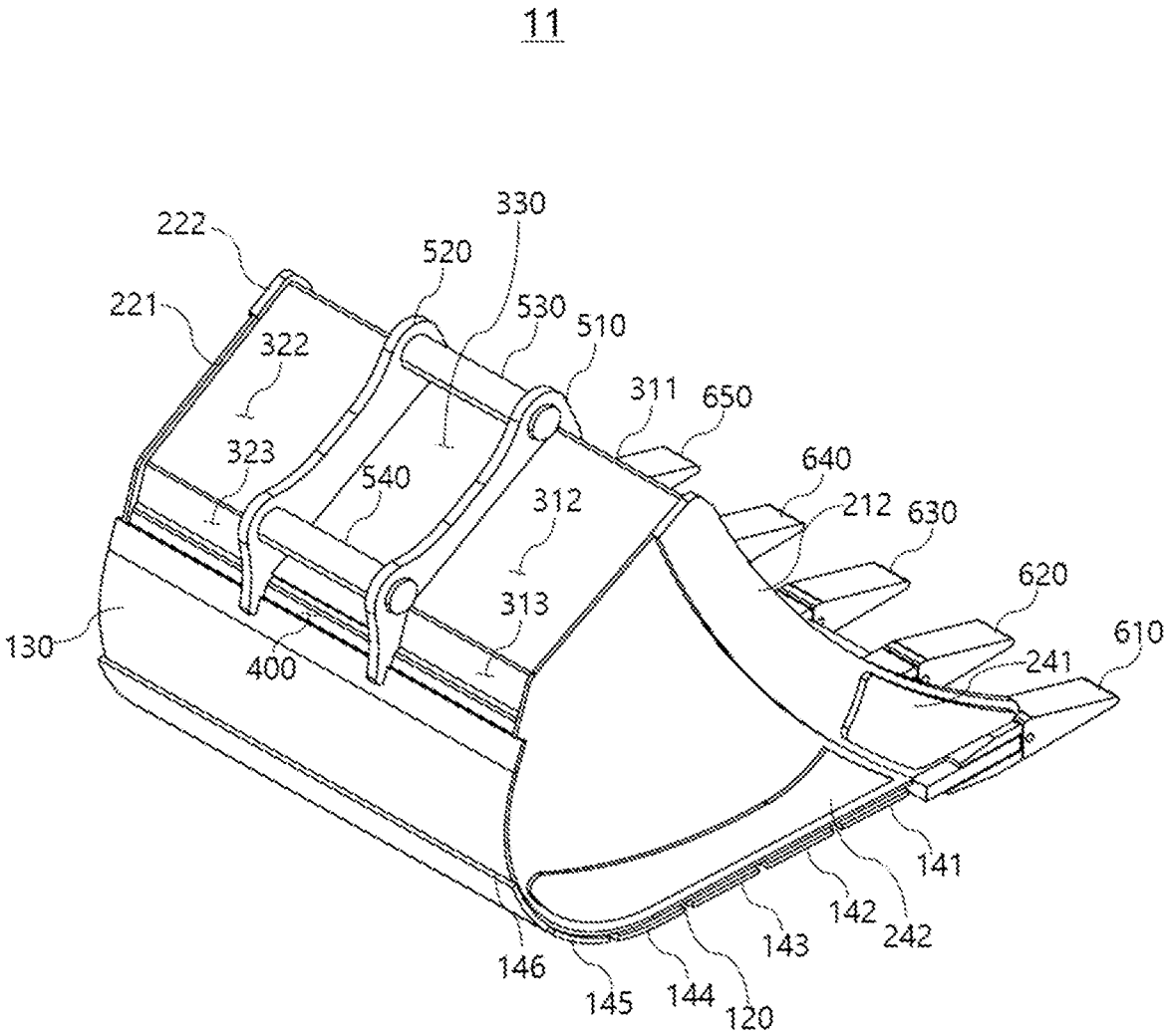
FIG. 7 is a rear perspective view showing the excavator bucket of FIG. 6.

FIG. 6 is a front perspective view showing an excavator bucket according to another embodiment of the present invention. FIG. 7 is a rear perspective view showing the excavator bucket of FIG. 6.

The embodiment as shown in FIGS. 6 and 7 is different from that as shown in FIGS. 1 to 5 in that a plurality of tooth parts 610, 620, 630, 640, and 650 are coupled to the first bottom part 110. The embodiment as shown in FIGS. 6 and 7 will be explained with respect to the difference from the embodiment as shown in FIGS. 1 to 5.

Referring to FIGS. 6 and 7, an excavator bucket 11 according to another embodiment of the present invention includes the plurality of tooth parts 610, 620, 630, 640, and 650. The plurality of tooth parts 610, 620, 630, 640, and 650 have respective adaptors and are thus coupled to the first bottom part 111 through the adaptors. When viewed on the front side of the excavator bucket 11, the plurality of tooth parts 610, 620, 630, 640, and 650 are spaced apart from one another at given intervals toward one side of the excavator bucket 11 from the other side thereof. The first tooth part 610 and the fifth tooth part 650 are coupled to the first side part 210 and the second side part 220.

In FIGS. 6 and 7, the excavator bucket 11 includes five tooth parts 610, 620, 630, 640, and 650, but the number of tooth parts may not be limited thereto. For example, the excavator bucket 11 may have 4 or less tooth parts or 6 or more tooth parts. When viewed on the front side of the excavator bucket 11, further, the number of tooth parts may be varied according to the width of the excavator bucket 11.

Like this, as the excavator bucket 11 includes the plurality of tooth parts 610, 620, 630, 640, and 650, it is easy to dig the soil or demolish a building.

Further, the coupling structure among the cover part 300, the support part 400, and the coupling brackets 510 and 520 of the excavator bucket 11 as shown in FIGS. 6 and 7 is substantially the same as that among the cover part 300, the support part 400, and the coupling brackets 510 and 520 of the excavator bucket 10 as shown in FIGS. 1 to 5, thereby enhancing the strength and rigidity of the excavator bucket 11 and in advance preventing the occurrence of cracks on the coupling brackets 510 and 520 and/or the coupling rods 530 and 540. Further, it is advantageous in decreasing the weight of the excavator bucket 11.

Figure 8:
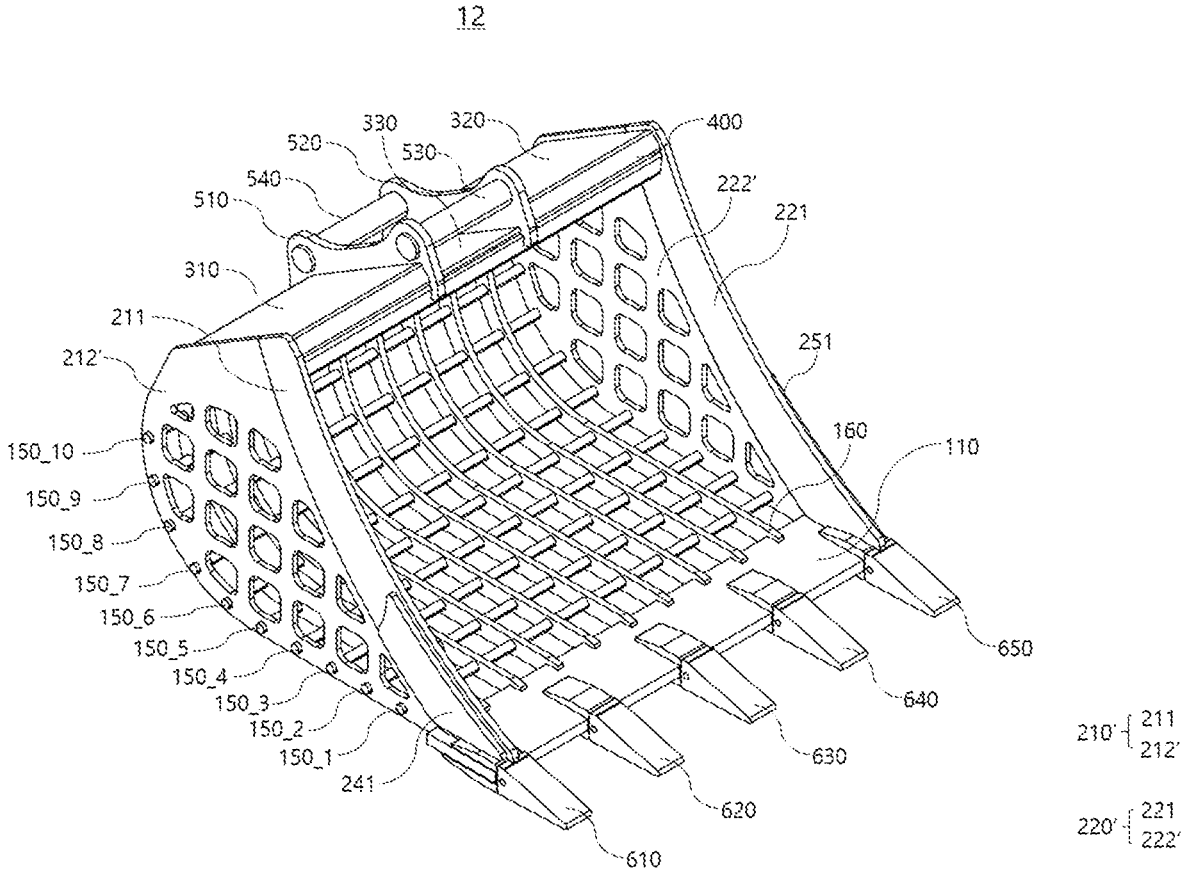
FIG. 8 is a front perspective view showing an excavator bucket according to yet another embodiment of the present invention.
Figure 9:
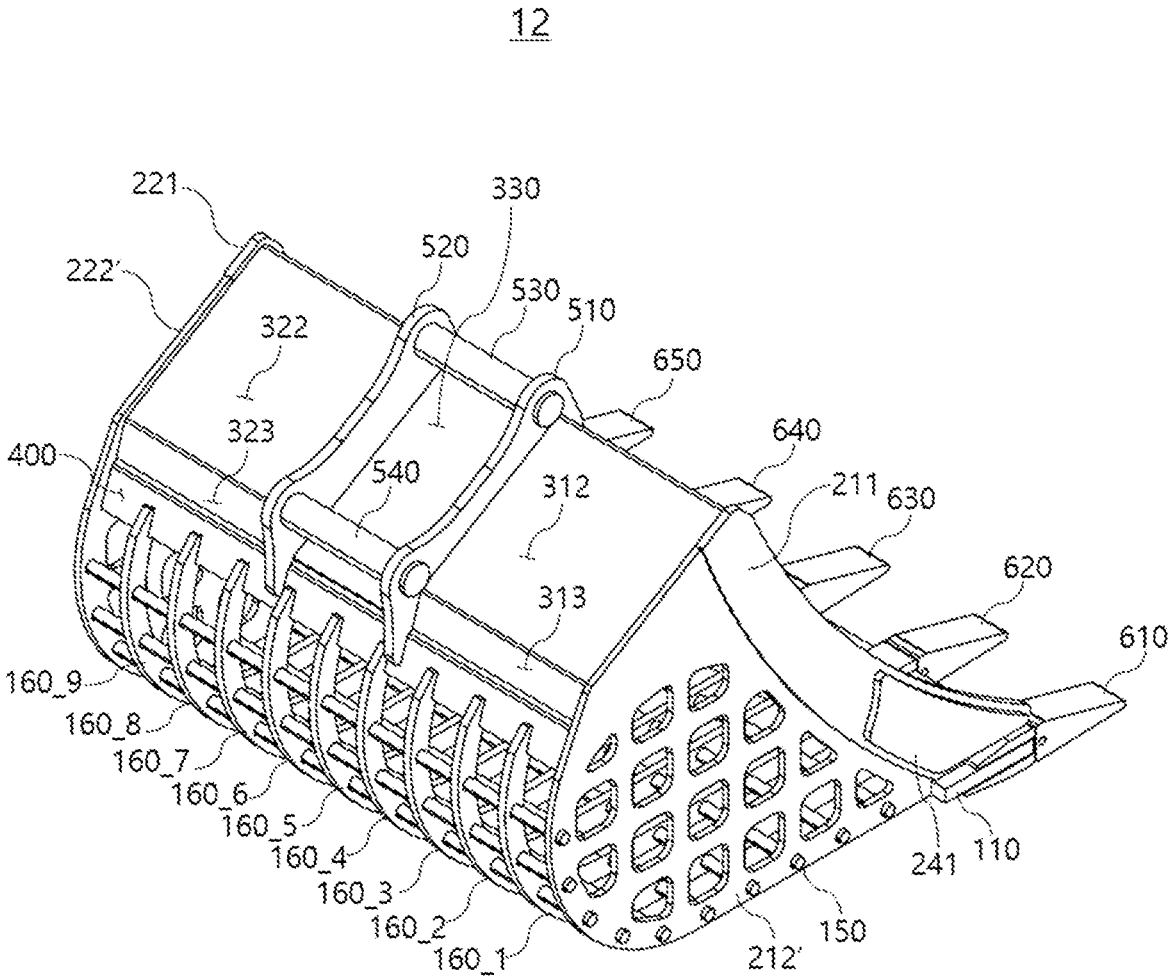
FIG. 9 is a rear perspective view showing the excavator bucket of FIG. 8.

FIG. 8 is a front perspective view showing an excavator bucket according to yet another embodiment of the present invention. FIG. 9 is a rear perspective view showing the excavator bucket of FIG. 8.

The embodiment as shown in FIGS. 8 and 9 is different from that as shown in FIGS. 6 and 7 in that side parts 210' and 220' have a plurality of holes and a plurality of horizontal bars 150 and a plurality of vertical plates 160 are provided instead of the second bottom part 120 and the third bottom part 130. The embodiment as shown in FIGS. 8 and 9 will be explained with respect to the difference from the embodiment as shown in FIGS. 6 and 7.

Hereinafter, the first side part 210' will be chiefly explained, for the convenience of the description, but the second side part 220' has substantially the same structure as the first side part 210'.

Referring to FIGS. 8 and 9, an excavator bucket 12 according to another embodiment of the present invention includes the first side part 210' divided into a first sub side part 211 and a second sub side part 212'.

The second sub side part 212' includes a plurality of holes. The plurality of holes include a plurality of first holes penetratedly formed on the excavator bucket 12 and a plurality of second holes to which the plurality of horizontal bars 150 are coupled.

The plurality of first holes may have substantially the same size as one another or different sizes from one another. Further, the plurality of first holes may have shapes of squares, squares with rounded corners, diamonds, triangles, and the like, but without being limited thereto, they may have the shape of a polygon such as a pentagon, hexagon, and the like or the shape of a circle. Further, the number of first holes is not limited particularly, but it may be determined in consideration of the purpose and total size of the excavator bucket 12.

The sectional shapes of the second holes have substantially the same as of the plurality of horizontal bars 150. The number of second holes is substantially the same as the number of horizontal bars 150.

The excavator bucket 12 includes the plurality of horizontal bars 150 and the plurality of vertical plates 160. The plurality of horizontal bars 150 and the plurality of vertical plates 160 cross perpendicularly. Accordingly, the plurality of horizontal bars 150 and the plurality of vertical plates 160 form the bottom part 100 of the excavator bucket 12, together with the first bottom part 110, and accordingly, the bottom part 110 of the excavator bucket 12 has the shape with a plurality of rectangular through holes.

The plurality of horizontal bars 150 include first to tenth horizontal bars 150-1, 150-2, 150-3, 150-4, 150-5, 150-6, 150-7, 150-8, 150-9, and 150-10. However, 9 or less horizontal bars 150 or 11 or more horizontal bars 150 may be provided, without being limited thereto.

When viewed on the front side of the excavator bucket 12, the lengths of the plurality of horizontal bars 150 are larger than or substantially the same as the width of the excavator bucket 12. The plurality of horizontal bars 150 are insertedly coupled to the plurality of second holes formed on the first side part 210 and the second side part 220. Further, the plurality of horizontal bars 150 pass through a plurality of third holes formed on the plurality of vertical plates 160 and are thus coupled to the plurality of vertical plates 160, which will be discussed later.

When viewed on the side of the excavator bucket 12, the plurality of horizontal bars 150 have the shape with a circular section, as shown in FIGS. 8 and 9, but they may have the shape with a polygonal section such as a triangle, square, polygon, and the like or an oval section.

The plurality of vertical plates 160 include first to ninth vertical plates 160-1, 160-2, 160-3, 160-4, 160-5, 160-6, 160-7, 160-8, and 160-9. However, 8 or less vertical plates 160 or 10 or more vertical plates 160 may be provided, without being limited thereto.

The plurality of vertical plates 160 extend from the first bottom part 110 and are bent upward along the outer shape of the side part 200 and thus coupled to the support part 400. That is, both ends of each vertical plate 160 are fixedly coupled to the first bottom part 110 and the support part 400. The side shape of each vertical plate 160 is substantially the same as of the second bottom part 120 and the third bottom part 130 as shown in FIG. 1.

Each vertical plate 160 has the plurality of third holes. The sectional shape of each third hole is substantially the same as of each horizontal bar 150 and each second hole. The number of third holes of each vertical plate 160 is substantially the same as the number of horizontal bars 150 and the number of second holes.

When viewed on the front side of the excavator bucket 12 in FIGS. 8 and 9, each vertical plate 160 has the shape with a rectangular section, but it may have the shape with a polygonal section such as a triangle, pentagon, and the like or a circular section.

Like this, the excavator bucket 12 is configured to have the second sub side part 212', the fourth sub side part 222', the plurality of horizontal bars 150, and the plurality of vertical plate 160, so that it is easy to filter objects (e.g., stone, waste, and the like) bigger than the plurality of rectangular through holes formed by crossing the first holes and/or the plurality of horizontal bars 150 and the plurality of vertical plates 160 of the second sub side part 212' and the fourth sub side part 222' or to dig uneven soil.

The respective features of the embodiments of the present invention may be coupled or combined partially or entirely, and further, the respective parts of the embodiments of the present invention may freely interlockingly operate. Also, the embodiments of the present invention may be implemented independently of one another or combinedly with one another.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be noted that the use of particular terminology when describing certain features or aspect of the disclosure should not be taken to imply that the terminology is being re-defined herein to be restricted to include any specific characteristics of the features or aspects of the disclosure with which that terminology is associated. It is therefore intended that the scope of the invention be limited not by this detailed description, but rather by the claims appended hereto.

The invention claimed is:

1. An excavator bucket comprising:

a bottom part forming bottom thereof, bent upward, and extending in a rear direction thereof;

first and second side parts coupled to both sides of the bottom part;

a cover part forming top thereof;

a support part coupled to at least a portion of the cover part and at least a portion of the bottom part and forming an inner surface thereof;

a first coupling bracket coupled to the cover part, the support part, and the bottom part and protruding upward and outward therefrom; and a second coupling bracket located on a position symmetrical to the first coupling bracket, wherein the cover part comprises a first cover part located between the first coupling bracket and the first side part and a second cover part located between the first coupling bracket and the second coupling bracket, and when viewed on the side of the excavator bucket, a height of the first cover part traversing the first coupling bracket is higher than a height of the second cover part traversing the first coupling bracket, wherein the first cover part comprises an upper extension portion coupled to one side surface of the first coupling bracket and a bent portion extending in a bent configuration from one end of the upper extension portion and coupled to one side surface of a first rod insertion portion, wherein the support part comprises a coupling portion coupled to the bent portion, and wherein the coupling portion comprises first, second, third and fourth sub coupling portions, the third sub coupling portion, being coupled to the bent portion, the second sub coupling portion extending in a bent configuration from the third sub coupling portion to an obtuse angle larger than 90° and coupled to the first coupling bracket, the first sub coupling portion extending in a bent configuration from the second sub coupling portion to an obtuse angle larger than 90° in the rear direction and coupled to a lower extension portion, and one end of the fourth sub coupling portion being coupled to the first sub coupling portion close to the second sub coupling portion and the other end thereof being coupled to the upper extension portion close to the bent portion.

2. The excavator bucket according to claim 1, wherein the first cover part traverses a height higher than or equal to ½ of the height of the first coupling bracket, and the second cover part traverses a height lower than or equal to ⅓ of the height of the first coupling bracket.

3. The excavator bucket according to claim 1, wherein the first coupling bracket comprises the first rod insertion portion having a rod hole into which a first coupling rod is inserted, a second rod insertion portion having a rod hole into which a second coupling rod is inserted, and a central extension portion located between the first rod insertion portion and the second rod insertion portion, and the first cover part further comprises a first rear portion bent from the other end of the upper extension portion, extending in the rear direction, and coupled to one side surface of the second rod insertion portion.

4. The excavator bucket according to claim 3, wherein an angle between the upper extension portion and the bent portion is an obtuse angle larger than 90°, and an angle between the upper extension portion and the first rear portion is an obtuse angle larger than the angle between the upper extension portion and the bent portion.

5. The excavator bucket according to claim 3, wherein the support part further comprises the lower extension portion extending from the coupling portion in the rear direction, spaced apart from the upper extension portion, and having at least a portion coupled to the first rear portion and a second rear portion extending in a bent configuration from the lower extension portion and coupled to the first coupling bracket and the bottom part.

6. The excavator bucket according to claim 1, wherein when viewed on the front side thereof, width of the fourth sub coupling portion is smaller than width between the first side part and the first coupling bracket, and the fourth sub coupling portion is coupled to the first coupling bracket.

7. The excavator bucket according to claim 1, wherein the separation distance between the upper extension portion and the lower extension portion becomes small in the rear direction thereof.

8. The excavator bucket according to claim 1, wherein the bottom part comprises a first bottom part located on the front side thereof and having a flat shape, a second bottom part extending from the first bottom part in the rear direction thereof and having a flat shape, and a third bottom part being bent upward from the second bottom part to a given curvature and coupled to the support part, the given curvature being in the range of 70 to 80°.

9. The excavator bucket according to claim 8, further comprising a plurality of tooth parts having respective adaptors, the plurality of tooth parts being coupled spaced apart from one another on the first bottom part, and at least two tooth parts of the plurality of tooth parts being coupled to the first side part and the second side part.

10. The excavator bucket according to claim 1, wherein the bottom part comprises a first bottom part located on the front side thereof and having a flat shape, a plurality of horizontal bars, and a plurality of vertical plates, and the first side part and the second side part comprise a plurality of holes having a plurality of first holes penetratedly formed on the excavator bucket and a plurality of second holes to which the plurality of horizontal bars are coupled, the plurality of vertical plates extending from the first bottom part, bent upward along the outer shape of the first side part, and coupled to the support part, and the plurality of horizontal bars and the plurality of vertical plates crossing perpendicularly.

* * * * *